US011920785B2

(12) United States Patent
Armbruster et al.

(10) Patent No.: US 11,920,785 B2
(45) Date of Patent: Mar. 5, 2024

(54) ARRANGEMENT HAVING TWO BURNERS

(71) Applicant: TRUMA GERÄTETECHNIK GMBH & CO. KG, Putzbrunn (DE)

(72) Inventors: Uwe Armbruster, Putzbrunn (DE); Andreas Schmoll, Putzbrunn (DE)

(73) Assignee: TRUMA GERÄTETECHNIK GMBH & CO. KG, Putzbrunn (DE)

( * ) Notice: Subject to any disclaimer, the term of this patent is extended or adjusted under 35 U.S.C. 154(b) by 561 days.

(21) Appl. No.: 17/267,518

(22) PCT Filed: Apr. 15, 2019

(86) PCT No.: PCT/EP2019/059612
§ 371 (c)(1),
(2) Date: Feb. 10, 2021

(87) PCT Pub. No.: WO2020/035174
PCT Pub. Date: Feb. 20, 2020

(65) Prior Publication Data

US 2021/0310653 A1 Oct. 7, 2021

(30) Foreign Application Priority Data

Aug. 17, 2018 (DE) ..... 10 2018 006 493.0

(51) Int. Cl.
*F23J 11/02* (2006.01)
*F23M 9/00* (2006.01)
*F23M 9/02* (2006.01)

(52) U.S. Cl.
CPC ..... *F23J 11/02* (2013.01); *F23M 9/006* (2013.01); *F23M 9/02* (2013.01); *F23J 2211/20* (2013.01)

(58) Field of Classification Search
CPC ..... F23J 11/02; F23J 2211/20; F23M 9/02; F23M 9/006; F23L 3/00; F23D 23/00; F23N 2237/02
See application file for complete search history.

(56) References Cited

U.S. PATENT DOCUMENTS

| | | | | |
|---|---|---|---|---|
| 4,256,030 | A | 3/1981 | de Bruin et al. | |
| 6,234,789 | B1 * | 5/2001 | Miyata | F23L 15/02 126/91 A |
| 6,575,269 | B1 | 6/2003 | Skoff et al. | |
| 9,228,744 | B2 | 1/2016 | Ergut et al. | |

(Continued)

FOREIGN PATENT DOCUMENTS

| | | | |
|---|---|---|---|
| AT | 503 506 | B1 | 10/2007 |
| CN | 103196143 | A | 7/2013 |

(Continued)

*Primary Examiner* — Alfred Basichas
(74) *Attorney, Agent, or Firm* — McNees Wallace & Nurick LLC

(57) ABSTRACT

The invention relates to an arrangement (1) including two burners (10), which has a common exhaust gas guiding device (2) and a common supply device (3) for combustion air. A backflow barrier (4) blocks a flow of a gaseous medium in a flow direction and is arranged in the exhaust gas guiding device (2) or in the supply device (3). The backflow barrier (4) has an opening (40) and a movable element (41) which is movable between two positions. The opening (40) is open in case the movable element (41) is in one of the two positions and closed in case the movable element (41) is in another of the two positions.

6 Claims, 9 Drawing Sheets

(56) References Cited

U.S. PATENT DOCUMENTS

Figure 1:
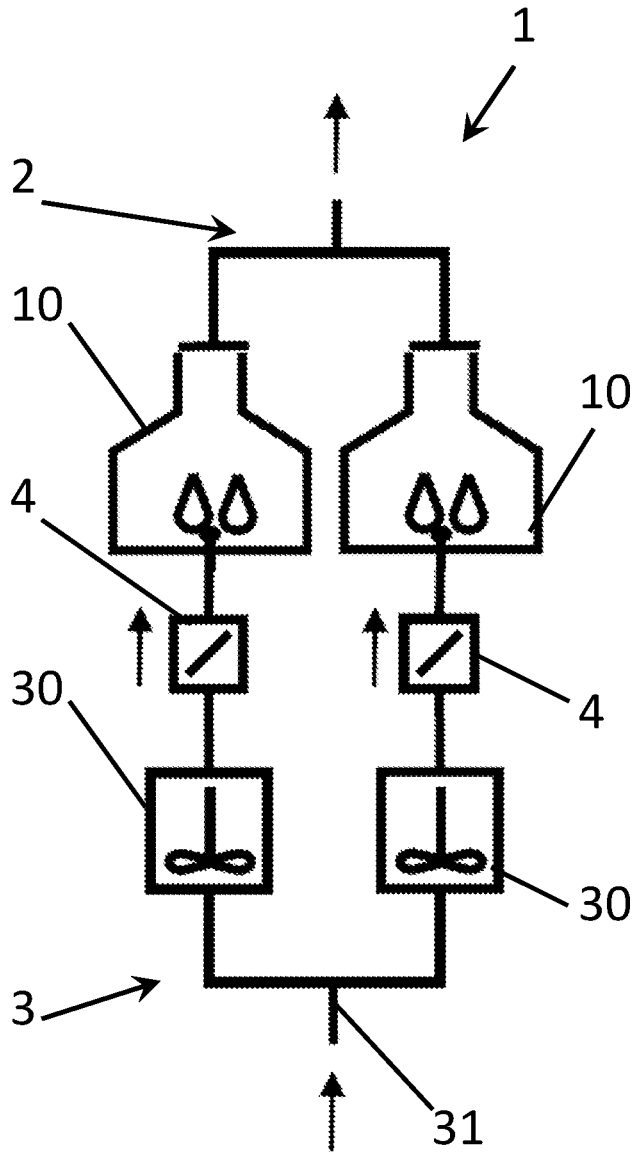

| | | | | |
|---|---|---|---|---|
| 2013/0175365 | A1 | 7/2013 | Ergut et al. | |
| 2016/0290631 | A1* | 10/2016 | Deng | F23C 1/00 |
| 2018/0017285 | A1 | 1/2018 | Armbruster et al. | |

FOREIGN PATENT DOCUMENTS

| | | | |
|---|---|---|---|
| CN | 107621081 | A | 1/2018 |
| DE | 29 03 054 | | 10/1979 |
| DE | 89 05 569 | U1 | 6/1989 |
| DE | 296 19 121 | U1 | 12/1996 |
| DE | 197 22 822 | A1 | 11/1998 |
| DE | 100 00 406 | A1 | 7/2000 |
| DE | 10000406 | A1 | 7/2000 |
| DE | 20 2006 010 099 | U1 | 9/2006 |
| DE | 20 2007 011 428 | U1 | 11/2007 |
| EP | 2985529 | A1 | 2/2016 |
| NL | 1014990 | C2 | 10/2001 |

* cited by examiner

ARRANGEMENT HAVING TWO BURNERS

The present invention relates to an arrangement having at least two burners. The arrangement generates for example hot air and/or heats water. The arrangement may form one single device, it may however also be formed by spatially distributed components.

If several devices (for example heaters, warm water heaters or refrigerators) are installed in a recreational vehicle (in particular a motor home or a caravan), which each have separate burners (in particular gas burners or liquid fuel burners), each device has a separate exhaust system and a separate combustion air intake. It is thus ensured that any device combinations can be installed at different fitting positions and mutual influences via the combustion air inputs and/or the exhaust systems are excluded. It can in particular be excluded that hot exhaust gases enter a burner having a combustion chamber, which is not in operation, at the back via the exhaust system. This may cause damage to a device as such a device is usually not designed for a rear flow therethrough with high temperatures.

The operation with a plurality of combustion air intakes and/or exhaust systems disadvantageously leads to a higher installation expenditure than in the case of a single combustion air intake and/or a single exhaust system. In particular for recreational vehicles, this is associated with the drilling out of outer walls, bottoms or roofs, each lead-through point having to be sealed in a weatherproof manner again. In addition to the increased costs and the possible quality problems in the long-term durability of such seals, a not insignificant optical impairment is caused on the outside of the recreational vehicle, which is increasingly classified as unacceptable.

Backflow barriers, for example for systems including a plurality of burners, are for example described in documents DE 100 00 406 A1, DE 89 05 569 U1, AT 503 506 B1, DE 197 22 822 A1, DE 20 2007 011 428 U1, DE 296 19 121 U1, DE 92 03 054 U1 or DE 0 2006 010 099 U1.

The object of the invention is to improve an arrangement including at least two burners in terms of applicability.

The invention achieves the object by means of an arrangement including at least two burners, the arrangement having an exhaust gas guiding device, the exhaust gas guiding device serving to jointly guide exhaust gases of the at least two burners, the arrangement having a supply device, the supply device supplying the at least two burners jointly with combustion air, the arrangement having at least one backflow barrier, the backflow barrier preventing a gaseous medium from flowing in at least one flow direction, the backflow barrier being arranged in the exhaust gas guiding device or in the air fuel supply device, the backflow barrier having at least one opening and at least one movable element, the movable element being movable between at least two positions, the opening being open in case the movable element is in one of the two positions, and the opening being closed in case the movable element is in another of the two positions.

In the arrangement according to the invention, a common exhaust gas guiding device and a common supply device (or alternatively: combustion air supply device) are provided for the at least two burners. The exhaust gas guiding device in particular serves to jointly conduct the exhaust gases of the at least two burners away, which are respectively guided separately out of the burners and are jointly guided to an exhaust gas outlet, for example a chimney. Due to this common exhaust gas guiding, there is the risk that the exhaust gases of a burner enter another burner. In one configuration, the combustion air supply device is such that the combustion air—as air serving for the combustion process—is separately supplied from a common combustion air supply—as am air inlet—to each burner—or to the components upstream the respective burner.

In order to maintain the same high safety standard in the arrangement as in the case of a completely separate and therefore non-common exhaust gas guiding, at least one backflow barrier is provided in the arrangement to prevent a gaseous medium from flowing in an undesired flow direction. The flow direction of a gaseous medium that is blocked by the backflow barrier may thus also be referred to as the blocking direction. In the application, the gaseous medium is in particular an exhaust gas.

The at least one backflow barrier or the plurality of backflow barriers blocks a flow in one (blocking) direction and thus prevents exhaust gases from reaching an undesired direction. In particular, the flow of exhaust gases from an (operated) burner to a (non-operated) burner or, for example, from an operated burner to the components associated with or downstream the non-operated burner is prevented. The backflow barrier is arranged in the exhaust gas guiding device or in the supply device. The supply device preferably supplies the at least two burners jointly with combustion air.

In case not all burners, each of which has a combustion chamber, are operated, it is generally prevented that exhaust gases can penetrate backwards into the non-operated combustion chamber (or the non-operated combustion chambers) and the components of the combustion system upstream the respective combustion chamber(s) due to the pressure conditions. Otherwise, there would be a risk of damage occurring, for example, due to high temperatures. In particular, combustion air blowers are usually not designed for higher temperatures.

A further advantage is obtained in that during operation without the participation of all burners, the exhaust gases flowing backwards are prevented from re-entering the common combustion air intake via the burner having a combustion chamber, which is not in operation. Otherwise, the mixture formation for combustion would be negatively affected by the exhaust gas recirculation, and a complete combustion could no longer be achieved. This would lead to increased CO levels in the exhaust gas. If too much exhaust gas is sucked in, the flame on the active burner could also go out.

The arrangement relates in particular to burners including combustion chambers (i.e. in particular burners having a combustion air blower) which are independent of each other. In one configuration, the arrangement in particular has only one common exhaust system and only one common combustion air intake, with combustion chambers which are independent of each other being provided.

Depending on the configuration, the backflow barriers act as a type of valve which permits a through-flow only in the preferential direction and prevents or at least sufficiently reduces a through-flow in the opposite direction. Preferably, the backflow barriers (alternative designation: backflow preventers) have an almost negligible flow resistance in the flow direction, so that they have a low and preferably negligible pressure loss in the flow direction. Preferably, the backflow barriers open slightly in the event of pressure differences in the permissible flow direction, thereby releasing the largest possible through-flow cross-sections. In the opposite direction to the through-flow direction, they preferably close automatically even without a pressure difference and, moreover, reliably withstand the pressures provided in the design.

The backflow barriers, and in particular the materials used, are preferably designed to reliably withstand the mechanical and thermal loads which occur during the intended period of use.

Preferably, the opening and closing functions of the backflow barriers are designed such that external accelerations, if possible, have no or only little effects. This is of particular importance when used in a recreational vehicle in which the burners having combustion chambers are also operated while driving. In this case, road irregularities and braking or acceleration of the vehicle inevitably cause accelerations at the backflow barriers as well. In one configuration, the backflow barrier(s) has/have only moving parts with a very low mass, so that the backflow barriers are hardly affected in their function by an acceleration acting from the outside (e.g. by operation while driving in a motor vehicle).

In addition, the backflow barriers should be particularly inexpensive to manufacture, and the additional expenditure involved in assembling the heating device should be as low as possible.

Depending on the configuration, at least one backflow barrier (as seen from the supply device to the exhaust gas guiding device and thus in the direction which the combustion air takes under normal conditions) is located at a point downstream a combustion air blower, but upstream the combustion chamber of the associated burner. Alternatively, a backflow barrier is located upstream the combustion air blower but downstream the branching of the combustion air supply to the individual burners. In both cases, the advantage is obtained that the temperature load for the backflow barriers—because they are in the inlet air area—is relatively low. The constructional design of the backflow barriers is thus simplified.

The arrangement has a plurality of blower-assisted burners which are to be used in combination with other devices such that they have only one common exhaust discharge or one common combustion air intake. In one configuration, the burners having combustion chambers are installed in different devices and, in an alternative configuration, are located within an overall device. For example—when divided into several separate devices—one device may serve for warm air heating and a second one for hot water heating (different basic functions). However, it is also conceivable to combine a first device for warm air heating with a second device for warm air heating.

One configuration provides that at least two backflow barriers are present. One configuration involves that one of the two backflow barriers is arranged in the exhaust gas guiding device, and that another of the two backflow barriers is arranged in the supply device. One configuration provides that one of the two backflow barriers is located upstream each of the two burners in the supply device. Upstream with respect to the combustion air, so that the combustion air passes first through the backflow barriers and only then through the burners.

One configuration involves that the supply device includes at least one blower device, and that the backflow barrier is arranged between the blower device and one of the two burners. In this configuration, the backflow barrier is located between the blower device and the associated burner in the direction which the combustion air takes from the supply device to the exhaust guiding device under normal or standard conditions. In this configuration, should hot exhaust gases enter a non-operated burner, the associated backflow barrier prevents the exhaust gases from continuing up to the blower device.

In one configuration, it is provided that the supply device has at least one blower device, and the blower device is arranged between the backflow barrier and one of the two burners. In this configuration, the backflow barrier is located upstream the blower device in the direction from the supply device to the exhaust gas guiding device—and thus in the direction which the combustion air takes under normal conditions—and upstream the burner located downstream in this direction and associated with the blower device. In one configuration, the blower device is to be designed so as to tolerate higher temperatures, as are typical for exhaust gases, for example.

In one configuration, the backflow barrier seals the section between a burner and the supply device such that, in the event that the associated burner is non-operated, there is no negative pressure in the area of the non-operated burner, so that consequently, no exhaust gases of the operated burner enter the non-operated burner.

One configuration involves that the backflow barrier is arranged in the exhaust gas guiding device. The backflow barrier in the exhaust gas guiding device in particular prevents exhaust gases from an operated burner from being supplied to a non-operated burner, as the exhaust gas is directly blocked. In one configuration, the backflow barrier is in particular located in the area in which the separate exhaust gas paths of the at least two burners are brought together.

In one configuration, it is provided that a backflow barrier acting on both sides is arranged at the junction of the individual exhaust gas ducts of the burners. The backflow barrier can thus allow a gaseous medium to flow in two directions. If only one combustion point is in operation, the backflow barrier placed there closes the exhaust gas duct of the combustion point which is not in operation. In one configuration, if both combustion points are in operation, the valve flap assumes a center position depending on the volume flow in the two exhaust gas ducts, to allow joint exhaust gas discharge from this point. In one configuration, the advantage is obtained in that only one backflow barrier is required for the combustion points, which can generally lead to a cost advantage.

According to the invention, it is provided that the backflow barrier comprises at least one opening and at least one movable element, that the movable element is movable between at least two positions, that the opening is open in case the movable element is in one of the two positions, and that the opening is closed in case the movable element is in another of the two positions. Preferably, the backflow barrier is configured such that in the unpressurized state, the movable element automatically moves to the position in which the opening is closed. In one configuration, the backflow barrier is configured such that the movable element can be moved from one position to the other position by a gaseous medium, for example by the combustion air or by a combustion air/fuel mixture. In this case, the backflow barrier preferably closes the opening when no gaseous medium acts on the movable element or when a gaseous medium acts on the movable element from a blocking direction. However, if a gaseous medium flows in the flow-through direction, the movable element releases the opening.

One configuration involves that the movable element is a centrally mounted diaphragm, in particular made of an elastomer. In one configuration, the diaphragm rests with a freely movable edge on a mounting point surrounding the diaphragm. The mounting point is thus a support surface for part of the diaphragm.

One configuration provides that the movable element, in case it rests in a mounting point, closes the opening, and that the movable element can be moved away from the mounting point by a gaseous medium.

One configuration involves that the movable element is at least partially elastic, and that in the event that a gaseous medium flows towards the movable element from one direction, the movable element elastically deforms such that the opening is released. Thus, the movable element is configured in the manner of a nozzle having an end face which includes the opening. The gaseous medium ensures that the movable element deforms appropriately and thereby releases the opening.

One configuration consists in that the movable element is configured as a nozzle, that a tip of the nozzle constrains the opening, that the movable element is at least partially elastic, and that in the event that a gaseous medium flows towards the movable element from one direction, the movable element elastically deforms such that the opening is released.

One configuration provides that the movable element is a flap mounted in a decentralized manner or on one side. The flap is preferably made of a material which is suitable for higher temperatures, and is designed and mounted such that, for example, exhaust gases allow the flap to tilt. The mounting is not around the center of the movable element, but offset therefrom. The mounting also causes the mass of the flap to be unevenly distributed around the mounting point.

One configuration involves that the backflow barrier is arranged in the exhaust gas guiding device, that one exhaust gas guide extends from each of the two burners, that one opening is associated with each exhaust gas guide, that the movable element is a flap mounted in a decentralized manner or on one side between the two openings, and that a position of the flap depends on a ratio of the exhaust gas quantities of the two burners.

According to one configuration, the supply device supplies the two burners with a mixture of combustion air and a gaseous fuel or a liquid fuel converted into a gaseous state.

One configuration consists in that the backflow barrier is at least one blower device of the supply device, and that the supply device supplies combustion air to one of the two burners via the at least one blower device even in case the burner is out of an operating state. Thus, the backflow barrier is provided by at least one blower device, and the blocking direction is the direction opposite to the direction of the combustion air (under normal conditions from the supply device to the exhaust gas guiding device). In this configuration, combustion air is supplied to a burner which is out of an operating condition and which is thus non-operated, so that the combustion chamber of the non-operated burner is purged with combustion air. The combustion air thus also passes through the non-operated burner and enters the exhaust gas guiding device as exhaust gas. Thus, exhaust gas from the operated burner is prevented from entering the non-operated burner in a supplementary or alternative manner. The advantage of this configuration is that no additional mechanical backflow barriers are required. In one configuration, the blower device is operated such that the energy consumption, if possible, is reduced.

Furthermore, in one configuration, the speed of the combustion air blower (or of the combustion air blowers) is monitored by a control unit such that the speed does not drop below the minimum speed necessary to prevent backflow. This is done, for example, by measuring the flow by means of sensors and by regulating the speed of the combustion air blower. Alternatively or additionally, the rotational speed of the combustion air blower is measured. In a further variant, a temperature is measured, the temperature being measured at such a point at which penetrating exhaust gases increase the temperature. For example, the temperature in or at a combustion air blower is determined. In a further configuration, a temperature is generally measured in such an area through which combustion air flows during normal operation and which is thus located upstream at least one burner. If the temperature rises above a tolerance range, this means that exhaust gases have been recirculated because the associated burner is not flushed with sufficient combustion air. The speed of the combustion air blower must therefore be increased to prevent the backflow.

In one configuration, it is provided that the blower device of the non-operated burner is operated just such that there is no risk of backflow of the exhaust gas, but that full power of the blower device is avoided.

Figure 2:
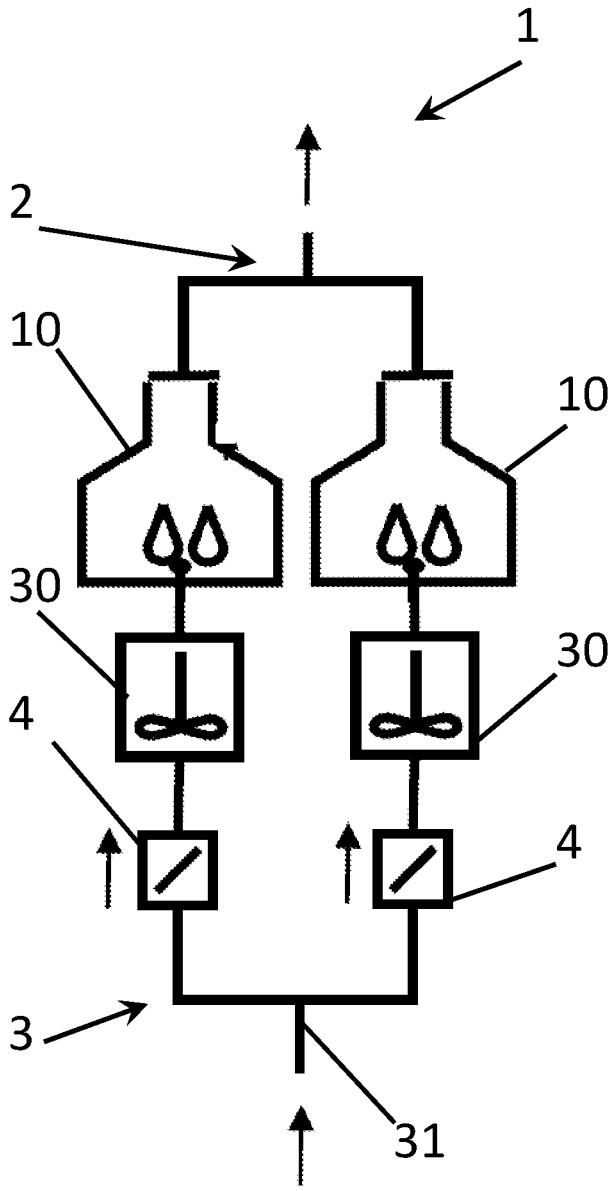
Figure 3:
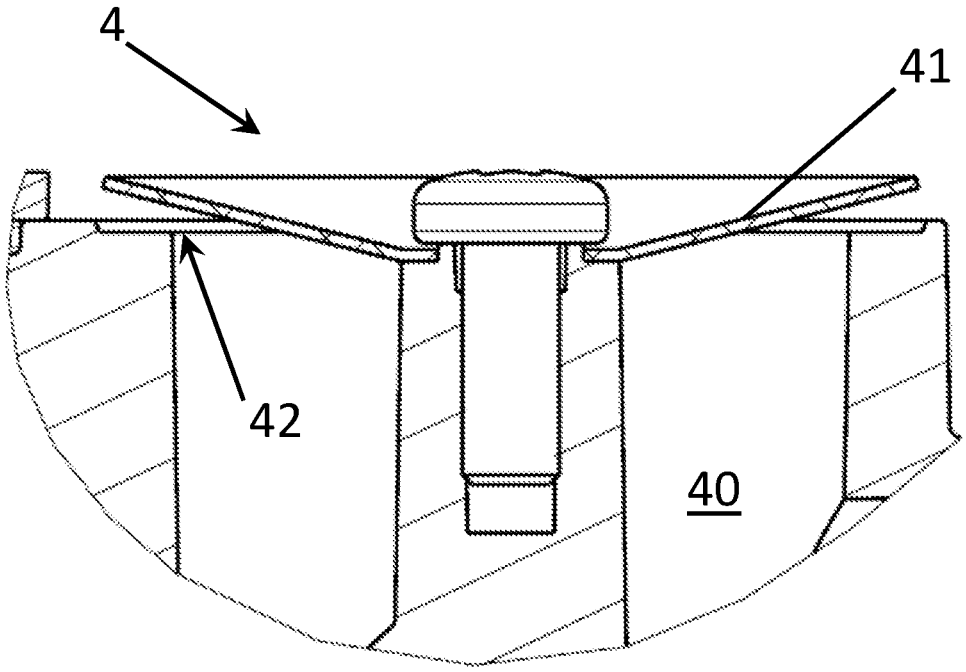
Figure 4:
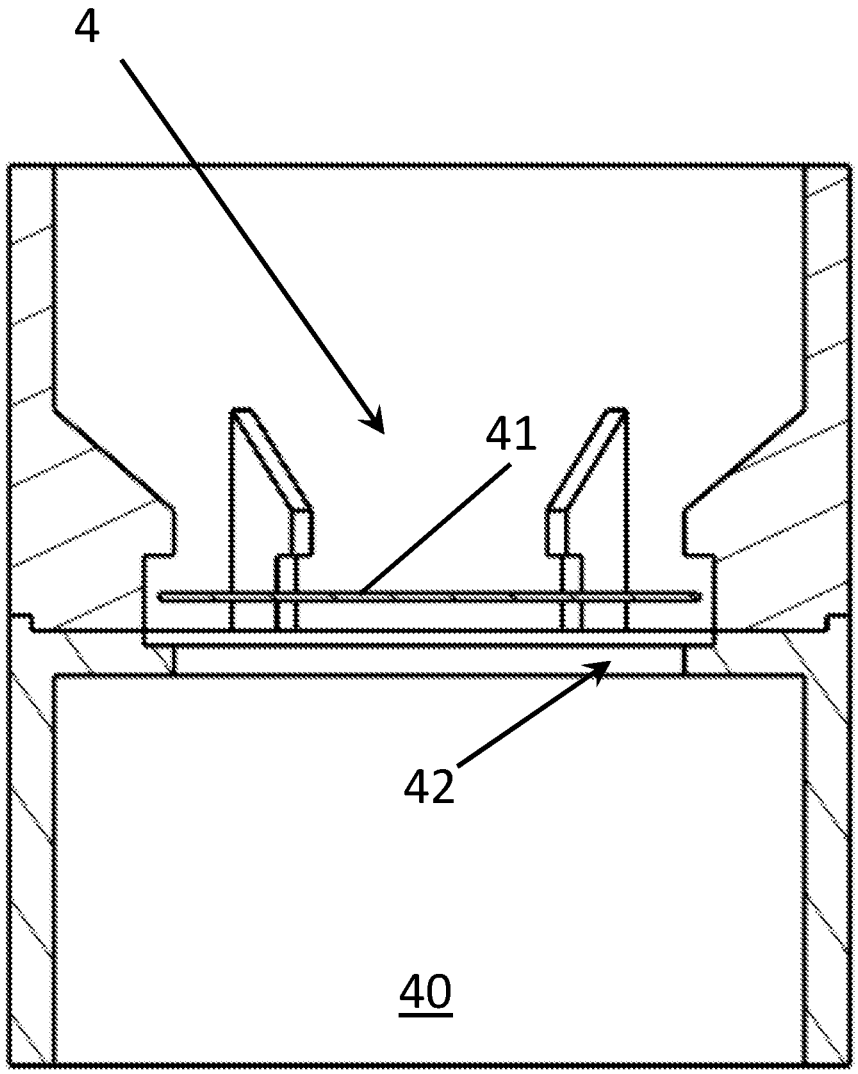
Figure 5:
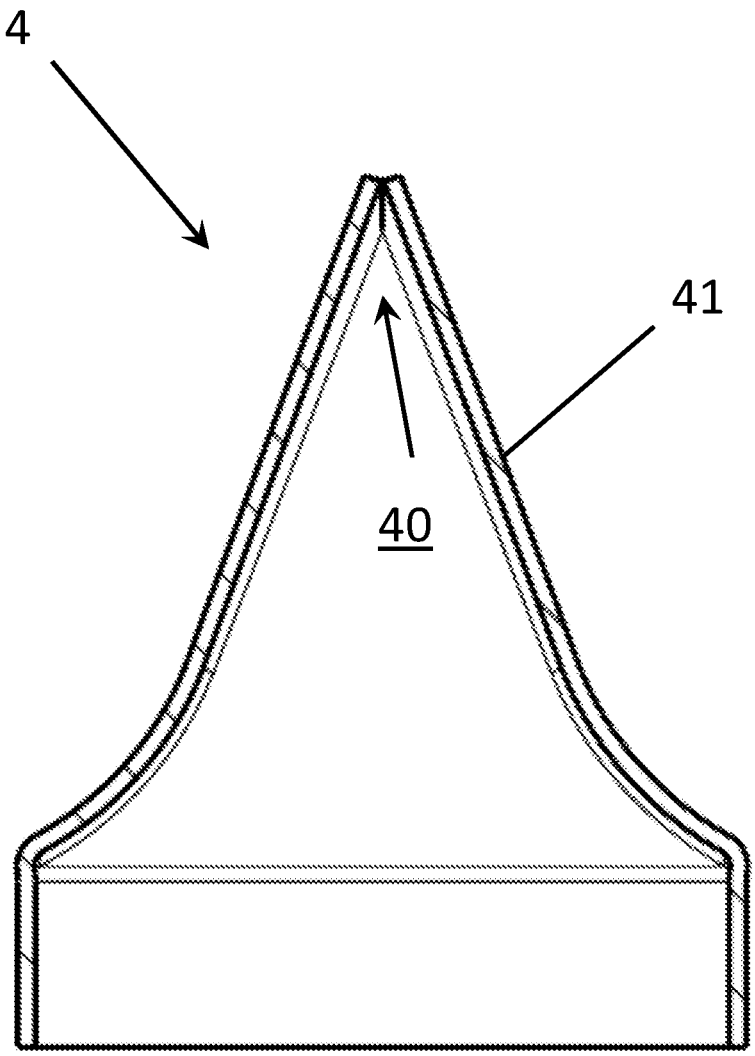
Figure 6:
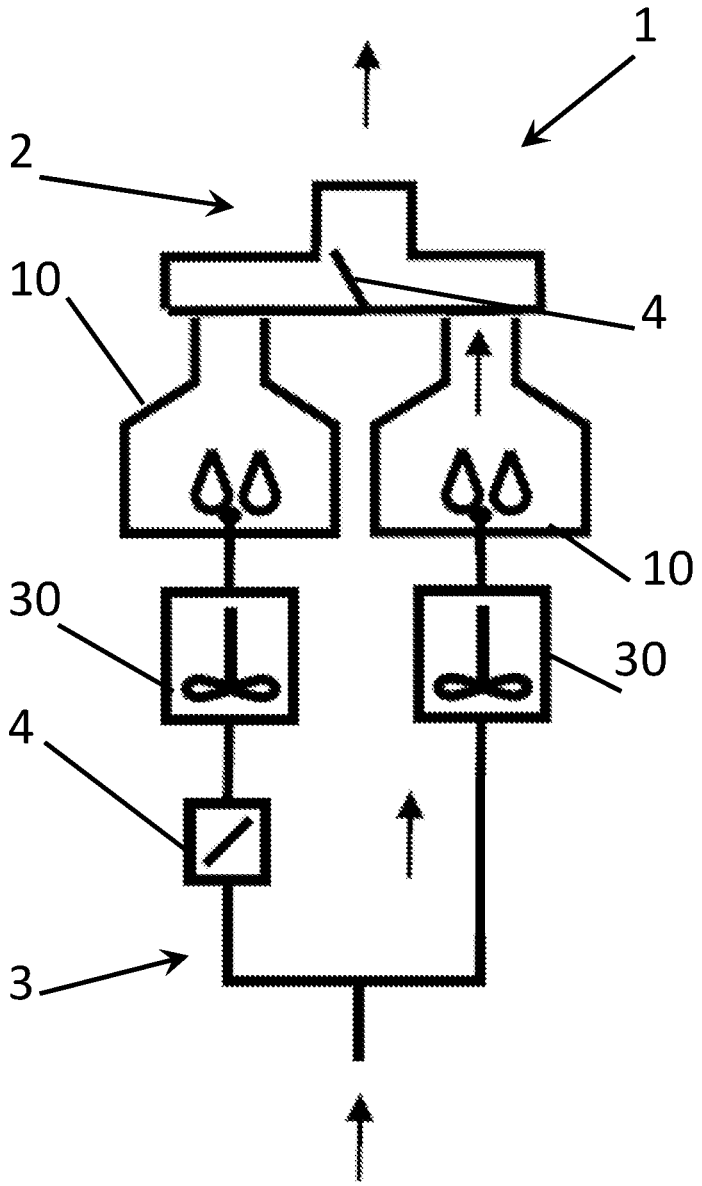
Figure 7:
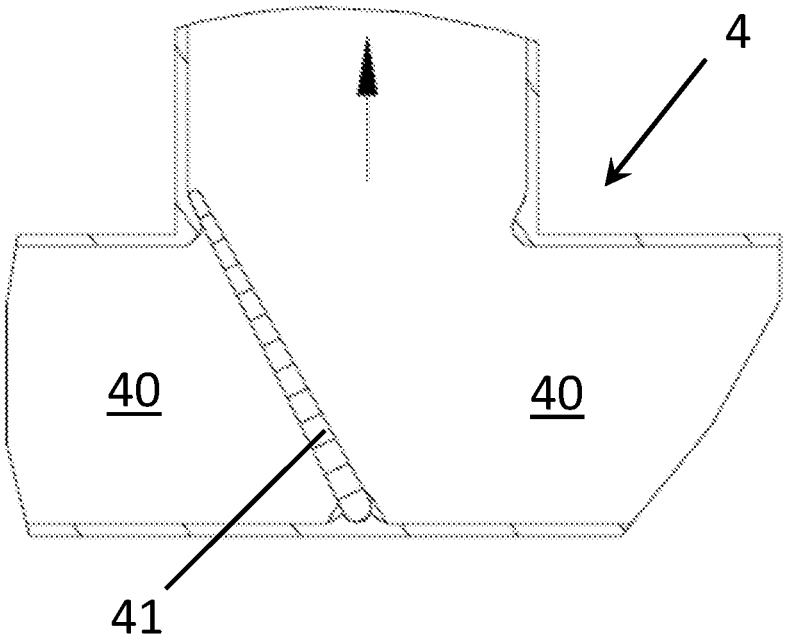
Figure 8:
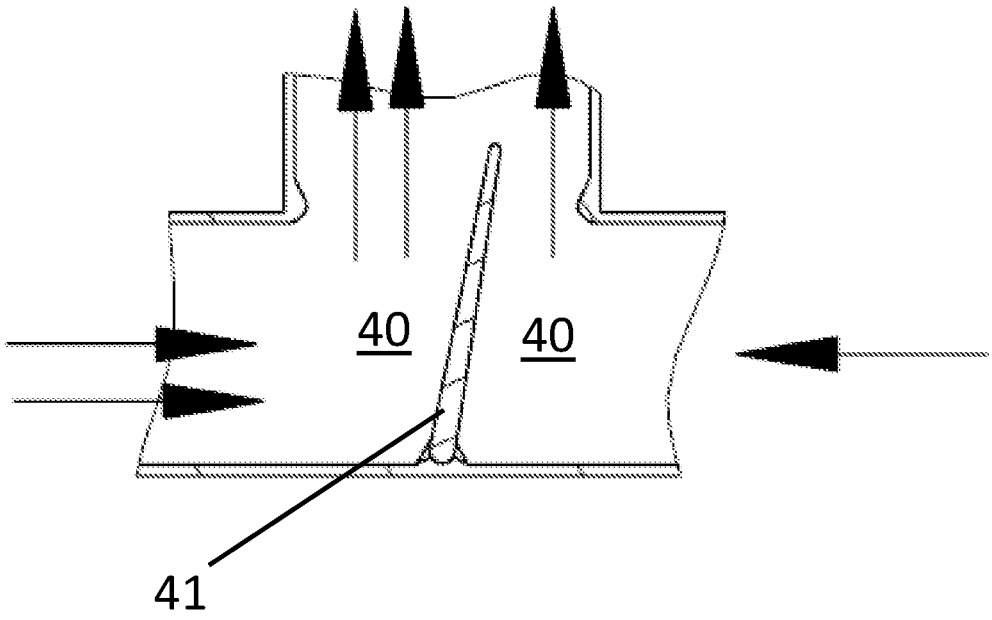
Figure 9:
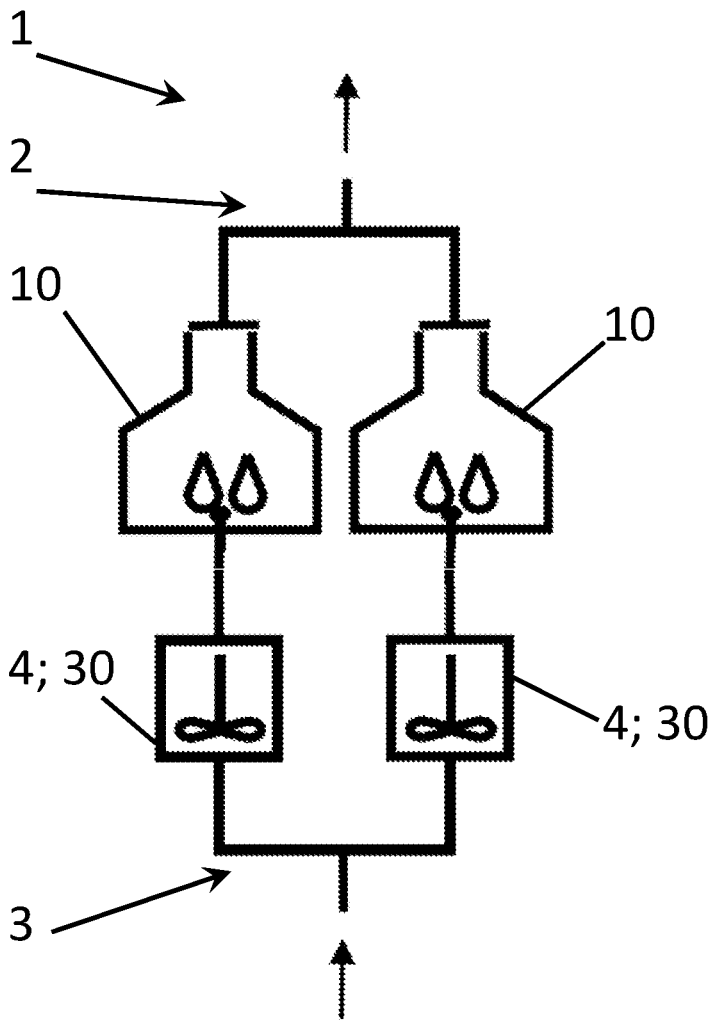

In detail, there are a multitude of possibilities for designing and further developing the heating device according to the invention. To this end, reference is made, on the one hand, to the claims depending on claim 1, and, on the other hand, to the following description of exemplary configurations in conjunction with the drawing, in which:

FIG. 1 shows a schematic representation of a first configuration of an arrangement including a plurality of burners, FIG. 2 shows a schematic representation of a second configuration of an arrangement including a plurality of burners, FIG. 3 shows a section through a first configuration of a backflow barrier not according to the invention, FIG. 4 shows a section through a second configuration of a backflow barrier not according to the invention, FIG. 5 shows a section through a configuration of a backflow barrier according to the invention, FIG. 6 shows a schematic representation of a third configuration of an arrangement including a plurality of burners, FIG. 7 shows a section through a further configuration of a backflow barrier according to the invention in a first state, FIG. 8 shows the configuration of FIG. 7 in a second state of the backflow barrier, and FIG. 9 shows a schematic representation of a fourth configuration of an arrangement including a plurality of burners.

FIG. 1 schematically shows an arrangement 1 including two burners 10, each of which has its separate burner chamber.

The burners 10 each receive their combustion air via a supply device 3, which has a single combustion air supply 31. The combustion air is supplied to the burners 10 via a respective blower device 30. The exhaust gases of the two burners 10 are discharged via a common exhaust gas guiding device 2 after having left the burner 10 via a separate exhaust gas outlet. Thus, the combustion air inlets of the two burners 10 are coupled to each other, and the exhaust gas outlets of the two burners 10 are coupled to each other.

In case only one of the two burners 10 is operated, there is a risk that exhaust gases from the one burner 10 enter the non-operated burner 10 and from there enter the section of the supply device 3 associated with the non-operated burner 10. In the configuration shown, the exhaust gases are primarily prevented from entering the blower devices 30. This is done here by arranging a respective backflow barrier 4 between a blower device (alternative designation: combustion air blower) 30 and the associated burner 10.

A gaseous medium can flow through the backflow barriers 4 only in the direction of passage (indicated by the drawn arrows) and thus in the direction of the burners 10. In the opposite direction, the backflow barriers 4 close the path and thus also particularly prevent exhaust gases (as a gaseous medium) from entering the blower devices 30.

In the variant of FIG. 2, the backflow barriers 4 are located upstream the blower devices 30 with respect to the combustion air and are therefore arranged further in the direction of the combustion air supply 31. This configuration allows, for example, the two blower devices 30 and the combustion air supply 31 to be designed as a common component. It is thus possible to simplify the manufacturing.

In alternative configurations, backflow barriers 4 are arranged at different positions of the supply device 3.

The following configurations refer to exemplary configurations of the backflow barriers 4 themselves. In most cases, an opening 40 is provided which can be closed or released by a movable element 41.

FIG. 3 shows a backflow barrier 4 not according to the invention, having an elastically movable diaphragm as a movable element 41. The diaphragm 41 is mounted centrally—here via a screw. The—here radially circumferential—edge of the diaphragm 41 rests—in the resting state—on a circumferential mounting point 42 in the illustrated configuration as the upper end face border of the opening 40.

If the gaseous medium flows in the desired direction—here drawn from the bottom to the top—the edge of the diaphragm 41 lifts off and a passage for the gaseous medium is generated between the diaphragm 41 and the surrounding mounting point 42 as a support. The opening 40 is thus open.

However, if a gaseous medium—e.g. the exhaust gas from the combustion of that burner to which the backflow barrier 4 is not assigned—presses against the diaphragm 41 from the top, the edge of the diaphragm 41 returns to its rest position and closes the opening 40. The same applies if no medium acts. This is generated due to the gravity and/or the design of the shape of the diaphragm 41.

FIG. 4 shows a configuration not according to the invention with a movable element 41, which is designed here as a disk and serves as a floating body.

If the gaseous medium presses against the disk 41 from below, the opening 40 is open and the medium can pass. To release the opening 40, the movable element 41 must be designed to be correspondingly light so as to be adapted to be lifted by a gaseous medium. For the fixing and also a reliable mounting, a plurality of (preferably at least three) clamping hooks are provided in the configuration shown, to prevent lateral movement of the movable element 41 and to restrict axial movement in the upward direction. As an alternative to the clamping hooks, a circumferential edge is provided.

In the state without a medium flowing in from below, the movable element 41 falls back into the mounting point 42 as a result of the force of gravity, and closes the opening 40. The same applies if a gaseous medium acts against the movable element 41 against the desired flow direction and thus in the blocking direction.

FIG. 5 shows a movable element 41 which is designed in the form of a nozzle and is elastic. The opening 40 is restricted by the upper tip of the nozzle 41. If the gaseous medium presses against the tip of the nozzle 41 from below, the material expands and the opening 40 is released. Without the inflow from this direction, the tip preferably closes by itself, as shown here. Furthermore, if a gaseous medium presses against the upper end face of the movable element 41 from above, the tip and thus the opening 40 is also closed.

Thus, the mobility of the movable element 41 refers either to the mobility with respect to the position and/or the geometry and the change between different geometric states of the element 41.

FIG. 6 shows a similar configuration of the arrangement 1 as FIG. 2. On the one hand, here only one backflow barrier 4 is present in the supply device 3 and is associated with only one burner 10. On the other hand, a backflow barrier 4 is additionally present in the exhaust gas guiding device 2 and is assigned to both burners 10. The exhaust gas guiding device 2 is designed here such that an exhaust gas guide extends from each burner 10 and such that the individual exhaust gas guides are combined to a common exhaust gas guide, e.g. a pipe or other conduit. Alternatively, a backflow barrier 4 is present only in the exhaust gas guiding device 2.

The backflow barrier 4 in the common exhaust gas guiding device 2 is designed here as a flap mounted on one side. It blocks the path of exhaust gases from an operated burner 10 to a non-operated burner 10.

FIG. 7 shows the case where only the right burner and not the left burner (cf. FIG. 6) is operated.

The exhaust gas of the right burner presses the movable element 41, which is mounted on one side, in the direction of the non-operated burner, which is arranged on the left in this case. Due to the arrangement and design of the movable element 41, which is in the form of a flap, the opening 40 of the left side of the piping system is thus closed, and the exhaust gas cannot reach the other burner. If the left burner and not the right burner were operated, the flap 41 would close the opposite opening 40.

If both burners are operated, the flap 41 assumes a center position, preventing backflow insofar as both combustion air blowers generate sufficient backpressure.

FIG. 8 shows the case where the left burner is operated at a higher output than the right burner (cf. FIG. 6). Thus, for example, more exhaust gas is produced by the left burner than by the right burner (indicated here by the arrows). Therefore, the flap 41 assumes a tilted position according to the ratio between the exhaust gas quantities, so that again for the burner with the lower output rate, the opening is closed to a greater extent. The back pressure against the exhaust gases, which is respectively generated by the combustion air blowers, prevents the exhaust gas from the burner having the greater output from entering the other burner at the rear.

FIG. 9 shows a configuration which can be implemented as an alternative or in addition to the previous variants.

The arrangement 1 has two backflow barriers 4, which may be present additionally or alternatively to the mechanical backflow barriers 4 of the above-discussed configurations and which are provided by the blower devices 30 themselves—preferably in connection with the type of control thereof.

This type of backflow barrier 4 consists in that the blower device 30 supplies combustion air to a burner 10 even if the burner 10 is not active, i.e. when no combustion takes place. Thus, the inactive or non-operated burners 10 are flushed with combustion air. Preferably, the amount of combustion air is such that exhaust gas from the active burner is just prevented from entering the inactive burner. In one configuration, a temperature is measured which provides information on whether exhaust gases have entered the area of the non-operated burner between the common exhaust gas guiding device 2 and the supply device 3. If the temperature rises above a tolerable limit, the speed of the blower device 30 associated with the non-operated burner 10 is increased, for example, to purge the non-operated burner 10 with more combustion air and thus counteract the exhaust gases.

LIST OF REFERENCE NUMERALS

1 arrangement
2 exhaust gas guiding device
3 supply device
4 backflow barrier
10 burner
30 blower device
31 combustion air supply
40 opening of the backflow barrier
41 movable element of the backflow barrier
42 mounting point of the backflow barrier

The invention claimed is:

1. An arrangement comprising:
at least two burners,
an exhaust gas guiding device, the exhaust gas guiding device serving to jointly guide exhaust gases of the two burners,
a supply device, the supply device supplying the two burners jointly with combustion air,
at least one backflow barrier,
wherein the backflow barrier preventing a gaseous medium from flowing in at least one flow direction,
wherein the backflow barrier is arranged in the exhaust gas guiding device or in the supply device,
wherein the backflow barrier has at least one opening and at least one movable element,
wherein the movable element is movable between at least two positions,
wherein the opening is open in case the movable element is in one of the two positions,
wherein the opening is closed in case the movable element is in another of the two positions,
wherein the backflow barrier is arranged in the exhaust gas guiding device,
wherein one exhaust gas guide extends from each of the two burners,
wherein one opening is associated with each exhaust gas guide,
wherein the movable element is a flap mounted in a decentralized manner or on one side between the two openings, and
wherein a position of the flap is dependent on a ratio of the exhaust gas quantities of the two burners.

2. The arrangement according to claim 1, wherein at least two backflow barriers are provided.

3. The arrangement according to claim 2,
wherein one of the two backflow barriers is arranged in the exhaust gas guiding device, and
wherein another of the two backflow barriers is arranged in the supply device.

4. The arrangement according to claim 1,
wherein the supply device has at least one blower device, and
wherein the blower device is arranged between the backflow barrier and one of the two burners.

5. An arrangement comprising:
at least two burners,
an exhaust gas guiding device, the exhaust gas guiding device serving to jointly guide exhaust gases of the two burners,
a supply device, the supply device supplying the two burners jointly with combustion air,
at least one backflow barrier,
wherein the backflow barrier preventing a gaseous medium from flowing in at least one flow direction,
wherein the backflow barrier is arranged in the exhaust gas guiding device or in the supply device,
wherein the backflow barrier has at least one opening and at least one movable element,
wherein the movable element is movable between at least two positions,
wherein the opening is open in case the movable element is in one of the two positions,
wherein the opening is closed in case the movable element is in another of the two positions,
wherein at least two backflow barriers are provided,
wherein one of the two backflow barriers is arranged in the exhaust gas guiding device, and
wherein another of the two backflow barriers is arranged in the supply device.

6. An arrangement comprising:
at least two burners,
an exhaust gas guiding device, the exhaust gas guiding device serving to jointly guide exhaust gases of the two burners,
a supply device, the supply device supplying the two burners jointly with combustion air,
at least one backflow barrier,
wherein the backflow barrier preventing a gaseous medium from flowing in at least one flow direction,
wherein the backflow barrier is arranged in the exhaust gas guiding device or in the supply device,
wherein the backflow barrier has at least one opening and at least one movable element,
wherein the movable element is movable between at least two positions,
wherein the opening is open in case the movable element is in one of the two positions,
wherein the opening is closed in case the movable element is in another of the two positions,
wherein the supply device has at least one blower device, and
wherein the blower device is arranged between the backflow barrier and one of the two burners.

* * * * *